US005957379A

United States Patent [19]

McMorrow et al.

[11] Patent Number: 5,957,379

[45] Date of Patent: Sep. 28, 1999

[54] DEVICE AND METHOD FOR PROVIDING ADDITIVES TO A STREAM OF WATER

[76] Inventors: Frank McMorrow, 33851 Calle Borrego, San Juan Capistrano, Calif. 92675; Donald E. Warehime, 549 Gise Cir., Corona, Calif. 91719

[21] Appl. No.: 08/969,485

[22] Filed: Nov. 13, 1997

[51] Int. Cl.[6] ..... B05B 7/30

[52] U.S. Cl. ..... 239/10; 239/318; 239/365; 239/304

[58] Field of Search ..... 239/317, 309, 239/302, 318, 10, 364, 365

[56] References Cited

U.S. PATENT DOCUMENTS

| | | | |
|---|---|---|---|
| 1,757,140 | 5/1930 | Pulkinghorn | 239/310 X |
| 2,120,774 | 6/1938 | Belmont | 239/310 X |
| 2,602,699 | 7/1952 | Otto et al. | 239/310 X |
| 3,194,444 | 7/1965 | Hubert | 239/310 X |
| 3,612,355 | 10/1971 | Stucky | 239/304 X |
| 3,943,960 | 3/1976 | Syrenne | 239/317 X |
| 4,225,085 | 9/1980 | Headen et al. | 239/317 |
| 4,840,311 | 6/1989 | Shambin | 239/307 X |
| 4,881,575 | 11/1989 | Smith | 239/307 X |

*Primary Examiner*—Kevin Weldon
*Attorney, Agent, or Firm*—Cleveland R. Williams

[57] ABSTRACT

A device is mounted between an inlet pipe and a shower head and includes a receptacle for mixing a stream of water with additives. A portion of the stream of water passing from the inlet pipe to the shower head is diverted into the receptacle. The receptacle includes replaceable containers, a first container containing a first additive and a second container containing a second additive. The diverted stream of water mixes with the first additive and the second additive upon contact with the first and second containers. The diverted stream containing additives is then returned to the main stream of water which exits the shower head. The flow of the diverted water to and from the receptacle is controlled by a valve. The present invention provides an improvement over known arrangements by providing additives which are kept separate from one another preventing a chemical reaction between the additives which would cause a loss of potency.

16 Claims, 4 Drawing Sheets

DEVICE AND METHOD FOR PROVIDING ADDITIVES TO A STREAM OF WATER

BACKGROUND OF THE INVENTION

1. Field of the Invention

The present invention relates to a device and a method for providing additives to a stream of water and, more particularly, to a device and a method for diverting a portion of a shower stream and mixing the diverted stream with additives, keeping the additives separate until contact with the diverted water stream.

2. Description of the Related Art

Conventional showers generally include an inlet pine with a threaded end to a conventional shower head. A number of arrangements have been suggested for use with shower heads so as to provide a means for mixing various liquid or solid additives such as soap, shampoo, and body oils with water for delivery to the body of a user. These known arrangements are mounted between the water inlet pipe and the shower head and allow the user to apply a variable amount of additive to the shower water.

Arrangements for providing shower additives are generally of two types. The first type dispenses a liquid additive directly into the water stream by a controlled dispensing apparatus. Examples of such liquid dispensing arrangements are shown in U.S. Pat. Nos. 3,486,695 and 4,219,158. The second type of arrangement diverts a portion of a water stream or the entire water stream into a mixing chamber where the water dissolves and mixes with an additive provided in the mixing chamber. Examples of this type of arrangement are shown in U.S. Pat. Nos. 3,581,996 and 3,847,354.

The mixture of aromatic botanical extracts with water for bathing is known as aromatherapy. The mixture of aromatic botanical extracts and mineral salts with a water stream would be a desirable combination for a bath or shower. However, if botanical extracts are exposed to mineral salts for a prolonged period of time, the mineral salts will cause oxidation of the extracts. This oxidation of the extracts eliminates a majority of the value and benefit of the aromatic character of the extracts. Therefore, in the known arrangements, it is not possible to combine the effects of botanical extracts and mineral salts in a stream of shower water.

SUMMARY OF THE INVENTION

The present invention provides an improvement over the known arrangements for providing additives to a shower stream by allowing two additives which would chemically react if kept in contact with one another to be added to the shower stream by maintaining the additives in separate containers until contact with the shower stream. According to exemplary embodiments of the present invention, a portion of the shower stream is diverted through a mixing chamber where it is mixed with additives such as aromatic botanical extracts and mineral salts maintained in the separate containers.

The present invention relates to a dispensing device and a method for providing additives to a stream of water. According to one embodiment of the invention, a receptacle for mixing the water with additives is attached to a fitting between an inlet pipe and a shower head. The fitting includes an inlet, an outlet, and a passage for water between the inlet and the outlet. Replaceable containers are inserted within the receptacle, a first container containing a first additive and a second container containing a second additive. Openings are provided for diverting a portion of the water from the passage to the receptacle and for delivering the diverted water mixed with additives from the receptacle to the passage. A control means is provided for controlling the flow of diverted water.

BRIEF DESCRIPTION OF THE DRAWING FIGURES

The invention will be described in greater detail with reference to the accompanying drawings in which like elements bear like reference numerals, and wherein.

DETAILED DESCRIPTION

According to exemplary embodiments of the present invention, solid and liquid additives to be added to a stream of water diverted from a main stream are kept in separate containers until contact with the diverted stream of water. Examples of containers for containing the additives are shown in FIGS. 1A–1E.

Figure 1A:
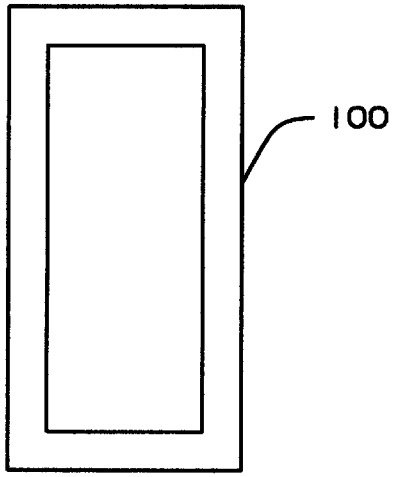
FIG. 1A is a front view of a container containing a liquid additive according to an exemplary embodiment of the present invention.
Figure 1B:
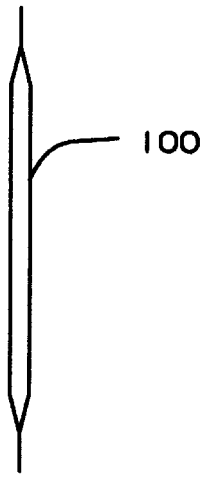
FIG. 1B is a side view of the container shown in FIG. 1A.
Figure 1C:
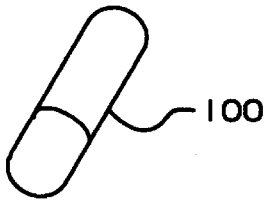
FIG. 1C is a front view of an alternative container containing a liquid additive according to an exemplary embodiment of the present invention.

FIGS. 1A and 1B are a front view and a side view, respectively, of an exemplary cartridge 100 containing one or more liquid additives. Alternately, the liquid additives may be contained in a capsule 100', as shown for example in FIG. 1C, or in a bag or pouch. The liquid additives may comprise, for example, botanical extracts or oils, vitamin compounds, colloidal compounds, glycolic compounds, and so on.

Figure 1D:
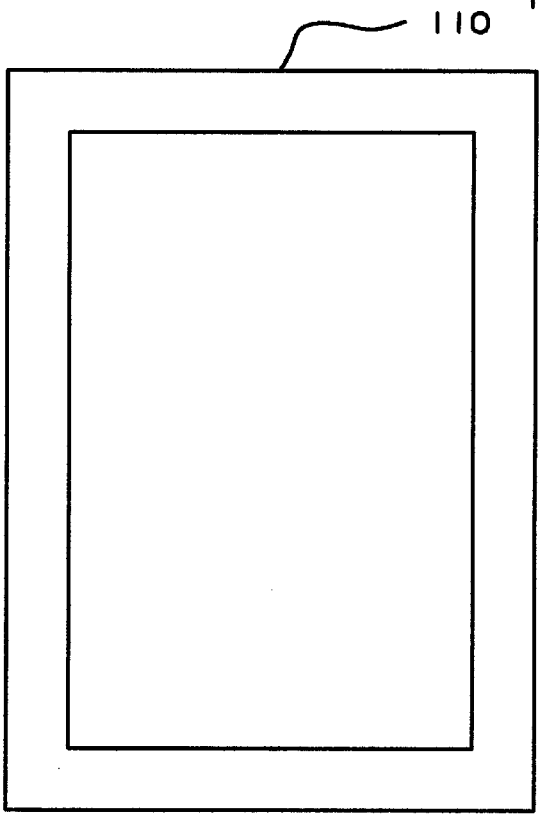
FIG. 1D is a front view of a container containing a solid additive according to an exemplary embodiment of the present invention.
Figure 1E:
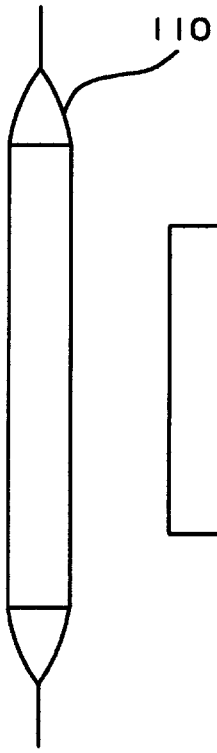
FIG. 1E is a side view of the container shown in FIG. 1D.
Figure 1F:
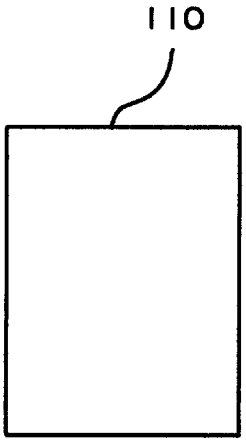
FIG. 1F is a front view of an alternative containment for a solid additive according to an exemplify embodiment of the present invention.

FIGS. 1D and 1E are a front view and a side view, respectively, of an exemplary cartridge 110 containing one or more solid additives. Alternately, the solid additives may be contained in a solid block of material 110', held together by pressure and/or a bonding agent, as shown for example in FIG. 1F, or in a capsule or a solid tablet. The solid additives may comprise, for example, mineral salts, antioxidants, and so on. Comparing FIGS. 1A–1C with FIGS. 1D–1F, the solid additives may be contained in larger containers than the liquid additives.

The containers are preferably made of a water-dissolvable material. For example, polyvinyl alcohol (PVA) film may be used as the material for containers that may be in the form of cartridges, pouches, packages, or bags. Also, gelatin, vegetable or Agar may be used as the material for containers that may be in the form of capsules, pouches, bags, cartridges, or solid tablets. In addition, those skilled in the art will appreciate that other water-dissolvable materials may be used for the containers.

For simplicity of illustration, the following description refers to liquid and solid additives contained in two separates cartridges 100 and 110, respectively. However, it will be understood that bags, pouches, capsules, tablets, or other types of containers may be used in place of the cartridges 100 and 110 to hold the liquid, solid, or other additives. In addition, although only two containers are shown, it will be understood that more than two containers may be used to contain any number of additives.

Figure 2:
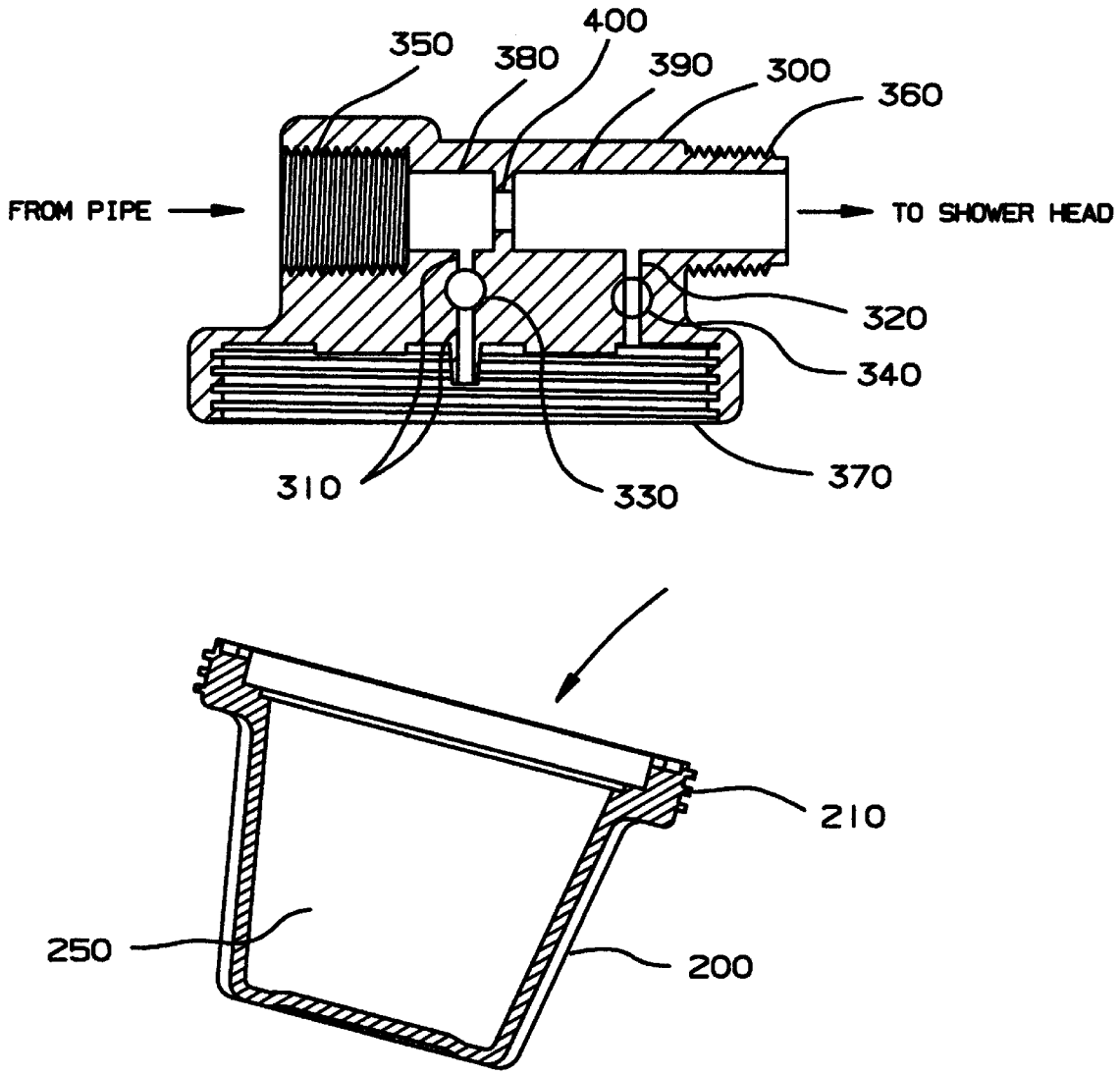
FIG. 2 is a cross sectional view of an unconnected fitting and receptacle according to an exemplary embodiment of the present invention.

The device according to one embodiment of the present invention includes a receptacle for mixing a diverted portion of a stream of water with various additives which are provided in cartridges 100 and 110 inserted within the receptacle, and a fitting which allows the receptacle to be mounted between a water inlet pipe and a shower head. FIG. 2 illustrates an exemplary unconnected fitting 300 and a receptacle 200. As shown in FIG. 2, the fitting 300 has an internally threaded portion 350 at one end to be attached to the inlet pipe (not shown) and an externally threaded portion 360 at the other end to be attached to a conventional shower head (not shown). The fitting 300 also has an internally threaded portion 370 for attaching the receptacle 200.

The receptacle 200 is preferably of a "cup" shape and is connected at an upper edge to the fitting 300. The receptacle 200 has external threads 210 for engaging the internally threaded portion 370 of the fitting 300.

In operation, the internally threaded portion 350 of the fitting 300 is screwed onto a water inlet pipe, and a shower head is screwed onto the externally threaded portion 360 of the fitting. A cartridge 100 containing one or more liquid additives and a cartridge 110 containing one or more solid additives are inserted into the receptacle 200. The receptacle 200 is then screwed onto the fitting 300. In this manner, cartridges or other containers containing additives to be added to shower water can be inserted into the receptacle 200, and the receptacle can be attached to the fitting 300 just before a shower. This permits a user to easily change the additives to be added to the shower water. Those skilled in the art will readily appreciate that the receptacle 200 may be attached to the fitting 300 by other means, for example, by clamps or snaps.

Figure 3A:
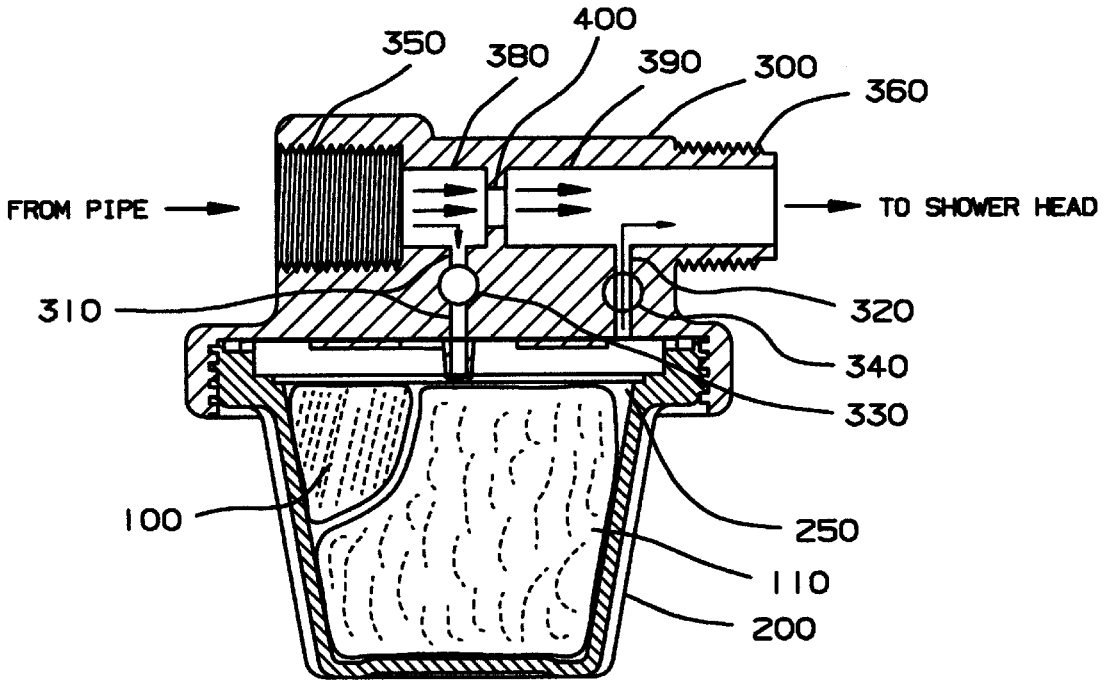
FIG. 3A is a cross sectional view of a connected fitting and receptacle according to an exemplary embodiment of the present invention.
Figure 3B:
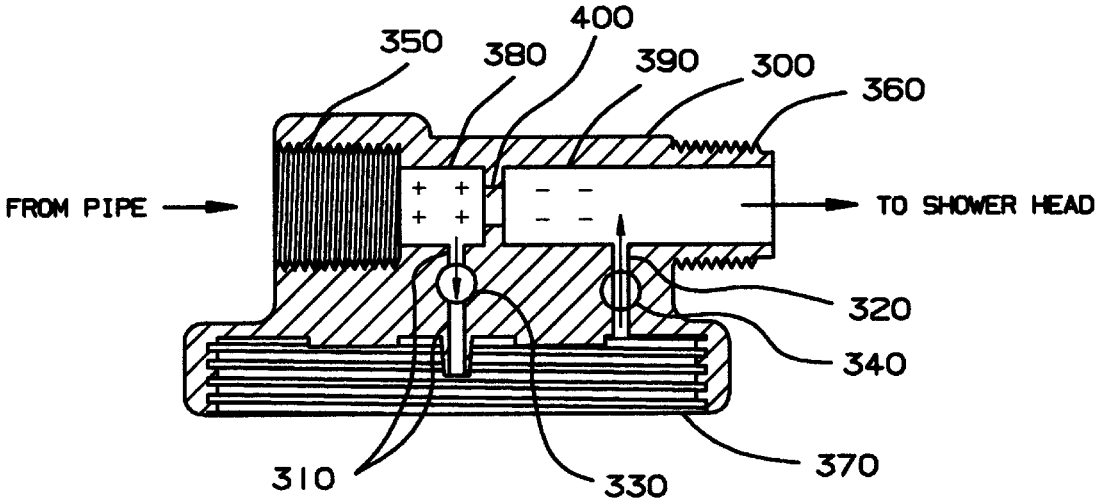
FIG. 3B is a cross sectional view of a fitting according to an exemplary embodiment of the present invention.

FIG. 3A illustrates the fitting 300 connected to the receptacle 200. The fitting includes an intake opening 310 and an outlet opening 320. The openings 310 and 320 may, for example, be cylindrical. The fitting 300 also includes an inlet passage 380, an outlet passage 390, and a flow constricting member 400. The flow constricting member 400 restricts water flow from the inlet passage 380 to the outlet passage 390, creating a pressure differential which forces water to be diverted towards the intake opening 310 and the receptacle 200. As illustrated in FIG. 3B, this differential pressure causes water to flow into and out of the receptacle 200 via the intake opening 310 and the outlet opening 320, respectively.

The water diverted into the receptacle 200 causes the cartridges 100 and 110 to dissolve, mixing the mineral salts or other solid additives in the cartridge 110 and the botanical extracts or other liquid additives in the cartridge 100 with the diverted water in a mixing chamber 250. The mineralized water with botanical extracts exits the receptacle 200 through the outlet opening 320 where it mixes with the main water stream and exits the shower head.

Figure 4A:
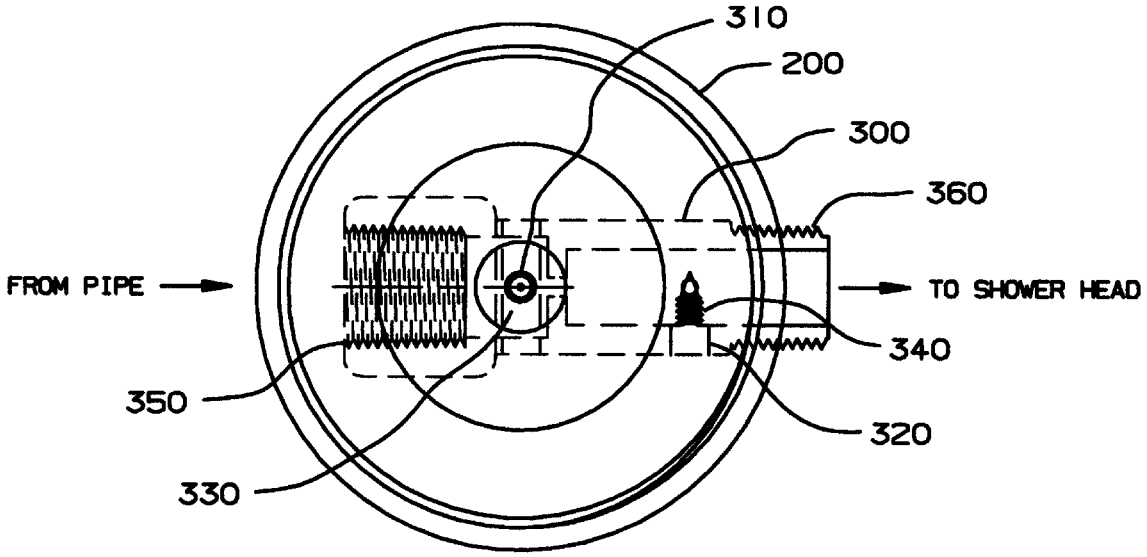
FIG. 4A is a top view of a device according to an exemplary embodiment of the present invention.

The device may include valves to control the flow of diverted water to and from the receptacle 200. As shown in FIG. 4A, an on/off valve 330 may be provided in the intake opening 310 (FIG. 3B) to control the flow of water from the fitting 300 to the receptacle 200, and a needle valve 340 may be provided in the outlet opening 320 (FIG. 3B) to control the flow of water from the receptacle 200 to the fitting 300. The longitudinal axis of the on/off valve 330 and the longitudinal axis of the needle valve 340 are perpendicular to the longitudinal axis of the intake opening 310 and the longitudinal axis of the outlet opening 320, respectively. In FIG. 3B, the ends of the valves 330 and 340 point into and out of the plane of the paper. In FIG. 4A, the lengths of the valves 330 and 340 extend across the plane of the paper.

Figure 4B:
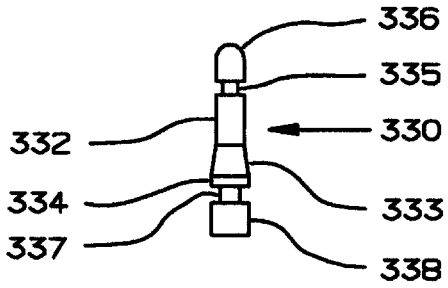
FIG. 4B is a side view of an on-off valve for use in the device of FIG. 4A.

A side view of the on/off valve is shown in FIG. 4B. Referring to FIG. 4B, the on/off valve 330 is a cylindrical member including a narrow portion 332, a tapered portion 333, a wide portion 334, a first circumferential groove 335, a rounded end 336, a second circumferential groove 337, and a straight end 338. When the valve 330 is mounted in the intake opening 310, the rounded end 336 and the straight end 338 valve extend from opposite side walls of the fitting 300, underneath the inlet passage 380. The ends 336 and 338 are used to slide the valve from a closed position where a wide portion 334 of the valve fills the opening 310 to an open position where the tapered portion 333 or the narrow portion 332 of the valve fills a portion of the opening 310. The flow rate of water to the receptacle 200 from the inlet passage 380 may be adjusted by pushing on the ends of the valve 330 and sliding the valve so that different diameter cross-sections of the tapered portion 333 intersect the opening 310. Although not shown, O-rings may be provided around the circumferential grooves 335 and 337 to provide a seal between the valve and the opening 310 and prevent the valve from leaking and to maintain the valve in a desired position.

Figure 4C:
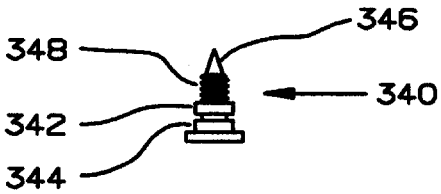
FIG. 4C is a side view of a needle valve for use in the device of FIG. 4A.

A side view of the needle valve is illustrated in FIG. 4C. The needle valve 340 is a cylindrical member including first and second wide portions 342 and 344, respectively, a pointed tip 346, and a threaded portion 348. The needle valve 340 fits in the outlet opening 320, with the pointed tip 346 and the first wide portion 342 extending from a side wall of the fitting 300, underneath the outlet passage 390. When the valve 340 is mounted in the outlet opening 320, the valve may be adjusted from a fully closed position where the first wide portion 342 meets the second wide portion 344 to a fully open position where the first wide portion 342 meets the pointed tip 346. The flow rate of water mixed with additives from the receptacle 200 may be adjusted by screwing the first wide portion 342 clockwise and counterclockwise, towards and away from the second wide portion 344. In this manner, the needle valve 340 may be adjusted manually to control the concentration of the mixture of additives and diverted water in the main stream by controlling the amount of the mixture flowing forth from the receptacle 200 to the outlet passage 390. The concentration of the mixture of additives and diverted water in the main stream can be adjusted, for example, to accomodate personal preferences of the user or to compensate for differences in water pressure at various locations.

Although the valve 330 has been described as an on/off valve, any conventional valve may be used which controls the flow of diverted water into the receptacle 200. In addition, although the valve 340 has been described as a needle valve, any conventional valve may be used which controls the flow of the mixture of additives and diverted water from the receptacle 200.

The separate containers 100 and 110 for liquid botanical extracts and solid mineral salts, respectively, allow the botanical extracts to be used to their full potential by preventing oxidation of the extracts by prolonged contact with the mineral salts. The containers according to the present invention may be prefilled. Prefilled containers according to the invention have a long shelf life due to the separation of the mineral salts and botanical extracts.

While the invention has been described in detail with reference to a preferred embodiment thereof, it will be apparent to one skilled in the art that various changes can be made, and equivalents employed without departing from the spirit and scope of the invention.

What is claimed is:

1. A dispensing device for providing additives to a stream of water comprising:

a receptacle for mixing the water with the additives; at least two replaceable containers inserted within the receptacle, a first container containing a first additive and a second container containing a second additive; and thread means for mounting the receptacle between a water pipe and a shower head, said receptacle including an inlet, an outlet, a passage for water between the inlet and the outlet, an intake opening for diverting a portion of the water from the passage into first and second chambers of the receptacle, wherein the first and second containers dissolve upon contact with the diverted water, causing the first and second additives, respectively to mix with the diverted water, and an outlet opening for delivering a mixture of the diverted water and the first and second additives from the receptacle to the outlet opening.

2. The dispensing device of claim 1, further comprising control means for controlling the flow of diverted water.

3. The dispensing device of claim 2, wherein the control means comprises a valve inserted in the intake opening, the valve controlling the flow of water into the receptacle.

4. The dispensing device of claim 3, wherein the valve is an on/off valve.

5. The dispensing device of claim 2, wherein the control means comprises a valve inserted in the outlet opening, the valve controlling the concentration of the mixture of diverted water and additives in the main stream of water by controlling the amount of the mixture flowing from the receptacle.

6. The dispensing device of claim 5, wherein the valve is a needle valve.

7. The dispensing device of claim 2, wherein the control means comprises a flow constricting member which restricts the flow of water from the inlet through the passage to the outlet.

8. The dispensing device of claim 7, wherein the flow constricting member creates a pressure differential between the inlet and the outlet which forces a portion of the water to be diverted into the receptacle.

9. A method of providing additives to a main stream of water comprising the steps of:

inserting at least two replaceable containers into a receptacle, a first container containing a first additive and a second container containing a second additive; diverting a portion of the main stream of water into the receptacle which contains a first chamber containing the first container and a second chamber which contains the second container;

dissolving the first and second containers by contact with the diverted water to cause the first and second additives, respectively, to mix with the diverted water; and returning the mixture of the diverted water and the first and second additives to the main stream of water.

10. The method of claim 9, further comprising a step of controlling the flow of the diverted water into the receptable.

11. The method of claim 9, wherein the mixing step is performed upon contact of the diverted water with the first container and the second container.

12. The method of claim 10, wherein the controlling step is performed by an On/Off valve.

13. The method of claim 9 further comprising a controlling step which includes controlling the concentration of the mixture of the diverted water and the additives to the main stream of water by controlling the amount of the mixture flowing from the receptacle to said main stream of water.

14. The method of claim 13, wherein the controlling step is performed by a needle valve.

15. The method of claim 9 further comprising a controlling step which includes restricting the flow of the main stream of water into and out of the receptacle.

16. The method of claim 15, wherein restricting the flow of the main stream of water creates a pressure differential which forces a portion of the main stream of water to be diverted into the receptacle.

* * * * *